US009182706B1

(12) United States Patent
Lidai et al.

(10) Patent No.: US 9,182,706 B1
(45) Date of Patent: Nov. 10, 2015

(54) METHOD AND SYSTEM FOR ADJUSTING A GAP BETWEEN ROLLERS OF A PRINTER IN ACCORDANCE WITH A MEDIA OR IMAGE LENGTH

(71) Applicant: Hewlett-Packard Indigo BV, Fort Collins, CO (US)

(72) Inventors: Uri Lidai, Nes Ziona (IL); Sagi Daren, Nes Ziona (IL); Assaf Berman, Rehovot (IL); Martin Chauvin, Tel Aviv (IL); Michel Assenheimer, Kfar Sava (IL)

(73) Assignee: Hewlett-Packard Indigo B. V., Maastricht (NL)

( * ) Notice: Subject to any disclaimer, the term of this patent is extended or adjusted under 35 U.S.C. 154(b) by 9 days.

(21) Appl. No.: 14/265,157

(22) Filed: Apr. 29, 2014

(51) Int. Cl.
*G03G 16/00* (2006.01)
*G03G 15/16* (2006.01)
*B41F 13/193* (2006.01)

(52) U.S. Cl.
CPC ..... *G03G 15/16* (2013.01); *B41F 13/193* (2013.01)

(58) Field of Classification Search
CPC ..... G03G 15/16; G03G 15/1655; G03G 15/1665; G03G 15/167; G03G 15/1685; G03G 2215/1619; G03G 2215/1676
USPC ..... 399/66, 302, 303, 304, 305, 308; 101/216, 217, 218; 271/272, 275, 277
See application file for complete search history.

(56) References Cited

U.S. PATENT DOCUMENTS

| | | | | |
|---|---|---|---|---|
| 4,760,789 | A * | 8/1988 | Witczak | 101/348 |
| 5,104,022 | A * | 4/1992 | Nakamura et al. | 225/100 |
| 5,242,364 | A * | 9/1993 | Lehmann | 493/8 |
| 7,860,417 | B2 | 12/2010 | Jones et al. | |
| 7,945,176 | B2 | 5/2011 | Hoshino et al. | |
| 8,200,145 | B2 | 6/2012 | Kondo | |
| 8,235,386 | B1 * | 8/2012 | Taig et al. | 271/272 |
| 8,789,462 | B2 * | 7/2014 | Chauvin et al. | 101/216 |
| 2007/0269230 | A1 * | 11/2007 | Hoshino et al. | 399/45 |
| 2012/0308274 | A1 * | 12/2012 | Leighton et al. | 399/317 |

FOREIGN PATENT DOCUMENTS

| | | | |
|---|---|---|---|
| JP | 61065279 | | 4/1986 |
| JP | 11042811 | A * | 2/1999 |
| JP | 2000016632 | A * | 1/2000 |
| JP | 2004238092 | A * | 8/2004 |
| JP | 2009198738 | A | 9/2009 |

OTHER PUBLICATIONS

Chen, C-L. et al.; "Banding Artifact Reduction for a Class of Color Electrophotographic Printers with Underactuated Motor/gear Configuration"; Jul. 2008; pp. 577-588; vol. 16: Issue 4.

* cited by examiner

*Primary Examiner* — Robert Beatty

(57) ABSTRACT

The invention relates to a method for adjusting a gap in a printing system in which a first roller and a second roller are provided, wherein at least one of said first roller and said second roller comprises a seam, said seam corresponding to in a variation of the diameter of said first roller and said second roller, respectively, along a circumference thereof. An interaction zone is provided, wherein said second roller is in rolling contact with said first roller under pressure, said interaction zone defining a gap for inserting a media to be printed. A size of said gap is controlled by varying a relative position of said first roller and said second roller when said at least one seam passes through said interaction zone, and said gap is adjusted in accordance with a length of said media to be printed and/or in accordance with a length of an image to be printed.

20 Claims, 5 Drawing Sheets

METHOD AND SYSTEM FOR ADJUSTING A GAP BETWEEN ROLLERS OF A PRINTER IN ACCORDANCE WITH A MEDIA OR IMAGE LENGTH

BACKGROUND

In an offset printer, a series of rollers transfers ink in the form of an image from roller to roller until the ink is finally transferred onto a media, such as paper. The media is fed into a printing nip or gap formed between two rollers, sometimes referred to as a transfer roller and a media roller. In some instances, the transfer roller comprises a blanket, such as an electrically conductive rubber-coated fabric, for transferring the ink to the media. This blanket is typically secured to a cylinder of the transfer roller via a clamp or other fastening mechanism, which introduces a seam or discontinuity on the surface of the transfer roller. The media roller oftentimes comprises another clamp or fastening mechanism for fastening or attaching the media, resulting in a further seam or discontinuity on the surface of the media roller.

The seams may disrupt the uniform pressure between the transfer roller and the media roller. This can be addressed by varying the relative position of the first roller and the second roller when a seam passes through the interaction zone in which the rollers are in rolling contact. By choosing a suitable gap profile, the size of the gap between the first roller and the second roller may be adjusted to compensate for the seams on the first roller and/or the second roller, respectively, thereby reducing disruptions caused by the seams.

While these techniques help to enhance the printing quality, problems remain when media of varying lengths are printed consecutively. In particular, after printing media of a given size, frame marks or paper size marks develop on the surface of the blanket. These frame marks are coincident with the media edges and may be attributed to mechanical abrasion or chemical changes of the blanket layers. These engravings may result in undesired paper size marks on subsequently printed longer printer media. To enable printing on the subsequent larger paper size, the blanket needs to be replaced, resulting in higher printing costs, reduced blanket life spans, increased press down time, and loss of productivity as well as increased paper waste.

It is possible to use different blankets for different media lengths. However, this requires the user to alternate between several blankets, which is time-consuming and awkward.

The effect of the paper size marks can also be alleviated by printing long media before short media. However, this requires a lot of advance planning; thereby reducing the degrees of freedom generally associates with digital printing.

The gap profile of the prior art may usually require a certain rise time and therefore may overlap with the media to be printed. These overlaps may lead to degradations of the printing quality when images are printed close to the media edge at which the overlap occurs.

DETAILED DESCRIPTION

Figure 1:
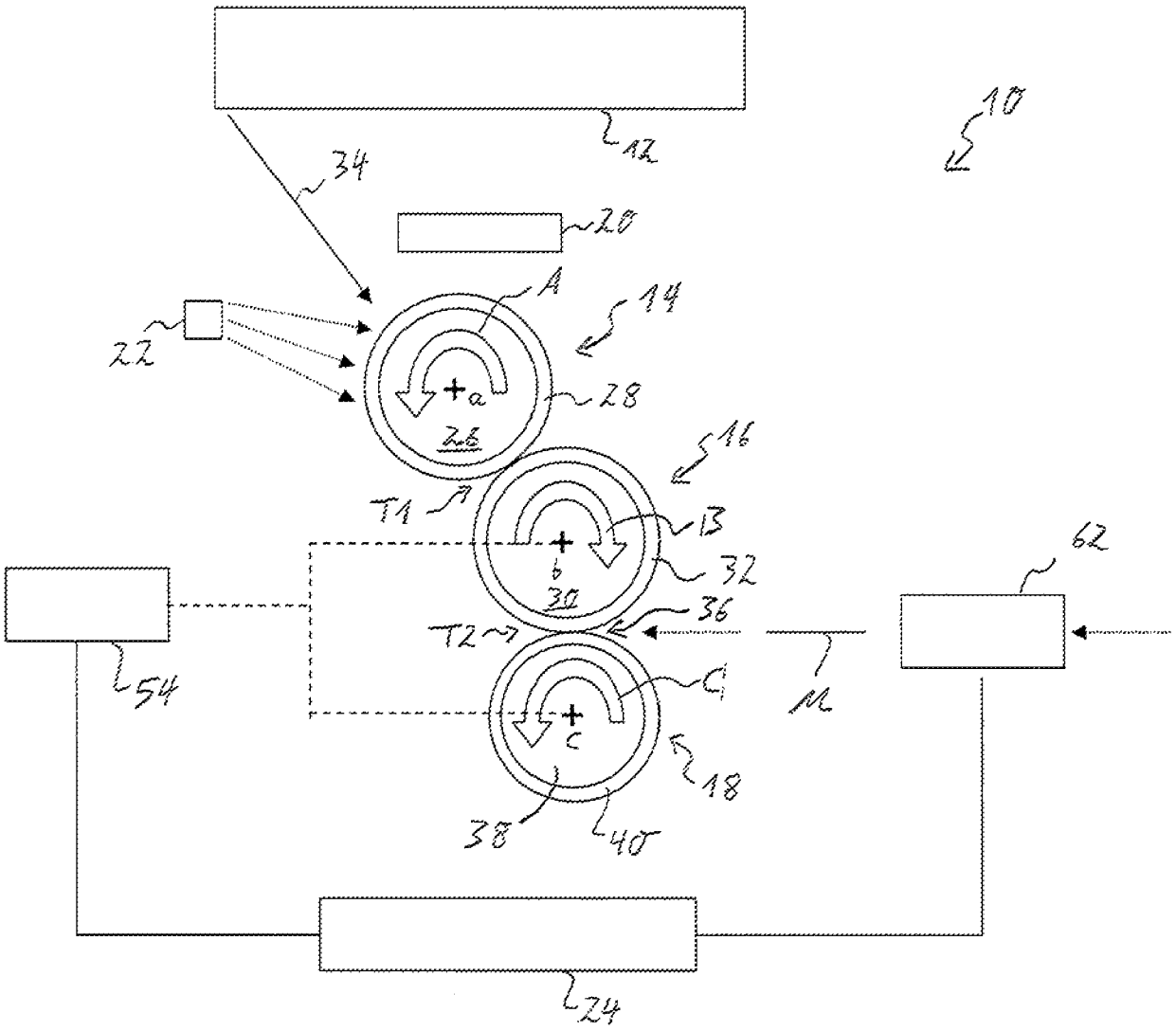
FIG. 1 is a schematic side view illustrating a printing system according to an example.

Examples are directed at a method for adjusting a gap in a printing system, comprising the steps of providing a first roller and a second roller, wherein at least one of said first roller and said second roller comprises a seam, said seam corresponding to a variation of a diameter of said first roller and/or said second roller, respectively, along a circumference thereof, providing a nip area where said second roller is in rolling contact with said first roller under pressure, said nip area defining a gap for inserting media to be printed, controlling a size of said gap by varying a relative position of said first roller and said second roller when said at least one seam passes through said nip area, and adjusting said gap in accordance with a length of said media to be printed and/or in accordance with a length of an image to be printed.

A media may refer to any substrate on which images can be printed, including paper, cardboard, or plastic materials such as foil.

The nip area may refer to an area or zone along a transversal direction of the rollers at which the first and second rollers interact. This may be a contact area created when compressible rollers are under pressure and are in physical contact, possibly with a media interposed therebetween. However, in case of discontinuities such as those caused by the at least one seam, there may not be continuous physical contact in the nip area.

Controlling said size of said gap may be achieved by varying a relative position of said first roller and said second roller as an input parameter for the control. This may be different from configurations that do not control a size of said gap as an input parameter, but rather focus on controlling a pressure between said rollers in said nip area. The latter control focuses on the output parameter, whereas the method according to the present disclosure controls the input parameter, namely a relative position of said first roller and said second roller.

It is possible to adjust the gap in a printing system both in the case in which media is fed into the nip area, and may be clamped to one of said first roller or second roller, as well as in null cycles in which no media is fed into the nip area and the second roller is in direct contact with said first roller, without any intervening media. In the first scenario, said gap may denote a distance of separation between said media attached to one of said first roller or said second roller and the opposing second or first roller, respectively, in the second scenario where no media is fed into the printing system, the gap may refer to a distance of the separation between the first and second rollers, without intervening media.

The gap may not represent an actual void, because the first roller or second roller may have an elastic surface and may deform or yield in response to the contact pressure between the first roller and the second roller, or because said first roller and/or said second roller may be elastically coupled to a frame of said printing system.

The effect of the paper size marks can be alleviated by adjusting the gap in accordance with the length of said media to be printed. Adjusting said gap in accordance with the media length may reduce the pressure at the media edges, thereby reducing the blanket engravings.

The printing quality can be further enhanced if, alternatively or additionally, the gap profile is adjusted in accordance with a length of an image to be printed. This may allow to extend the gap profile further into the printing zone if the image to be printed is short, and hence sufficiently far away from the trailing edge of the media. On the other hand, the overlap between the gap profile and the media can be reduced for longer images to be printed, which extend closer to the media edge. This allows achieving a favorable trade-off between the conflicting targets of reducing the paper size marks and maintaining a high printing quality throughout the printing zone, even close to the seams.

A length of an image to be printed may refer to the length of the image as measured from the leading edge of the media. Alternatively, the length of the image to be printed may refer to the distance of the image from the trailing edge of the media, or from the seams.

Printing marks or print control signs such as crop marks, finishing marks, barcodes and/or color control patches that may appear in the vicinity of the trailing edge may not be considered part of the image in the sense of this disclosure, and hence may be disregarded when determining said length of said image to be printed.

Said gap may be adjusted differently for different color separations.

In an example, a length of said gap is adjusted in accordance with said length of said media to be printed and/or in accordance with said length of said image to be printed.

Said length of said gap may refer to a length along said circumference of said rollers. Said length may be measured in terms of a rotation angle, or in terms of a corresponding length of media experiencing the gap while being fed through said nip area. Alternatively, said length may be measured as a time length or duration of said gap, corresponding to the duration for which said relative position of said first roller and said second roller is increased or decreased, such as to accommodate and compensate for seams in said first roller and/or second roller.

A length of said gap may be increased if said length of said media is decreased and/or said length of said image is decreased.

Conversely, a length of said gap may be decreased if said length of said media is increased and/or said length of said image is increased.

While the length of said gap may be varied; a depth of said gap may remain constant.

A depth of said gap may relate to an extension of said gap in a direction perpendicular to the length of said gap, and may in particular relate to a separation between said first roller and said second roller.

By keeping the general shape and the depth of the gap constant, the gap may be adjusted according to the length of the media with minimum computational effort. This facilitates an efficient implementation of this disclosure, and also allows to upgrade existing printers.

It is possible to reduce the computational effort associated with varying a media length or varying an image length from a media/image length to multiple profile mapping with many parameters to a scalar one-to-one map of media length/image length to gap profile length.

In an example, said seam may correspond to a recess in said first roller or aid second roller, hence a reduced diameter.

Said first roller may comprise a cylinder and an elastic outer portion at least partially covering said cylinder. In particular, said elastic outer portion may be or may comprise a blanket, such as in liquid electrophotographic printing machines.

Said seam may be formed in said first roller, and may in particular correspond to a seam in said blanket, or a damping or fastening device for said blanket.

Alternatively or additionally, a seam may be formed in said second roller, said seam in particular corresponding to a clamping or fastening device adapted to damp or attach said media to said second roller.

In an example, the first roller and the second roller may be a transfer roller and a media roller, respectively, which are in rolling contact with each other to form a gap for transferring an ink image onto a media passing through the gap. In other examples, the first roller and the second roller comprise a pair of rollers of a printer other than a transfer roller and/or a media roller.

Said gap may extend only along part of a circumference of said first roller and/or second roller, respectively, henceforth denoted first portion and corresponding to or including said seam. Adjacent portion will be denoted second portions, and may correspond to or include the printing zone where no seam is present.

In an example, said gap is controlled in accordance with a gap profile, said gap profile varying in a first portion corresponding to said seam passing through said nip area.

Said gap may be adjusted in accordance with said length of said media so that a distance between said first portion and a trailing edge and/or a leading edge of said media remains substantially constant.

Said distance may be an angular distance or distance measured along said circumference when said media is wrapped around said first roller or said second roller, respectively.

In an example, said step of adjusting said gap comprises a step of stretching said first portion of said gap profile.

Said first portion may comprise a first section corresponding to an increase of said gap, in particular an increase of a depth of said gap, a second section corresponding to a decrease of said gap, in particular a decrease of a depth of said gap, and a peak section formed between said first section and said second section.

Depending on the choice of reference for the steady state against which variations are measured, said first section may be a rising (increasing) or falling (decreasing) section in said gap profile. Correspondingly, said second section may be a falling (decreasing) or rising (increasing) section of said gap profile.

Adjusting said gap may comprise a step of varying a length of said peak section, in particular extending said length of said peak section in accordance with said length of said media and/or in accordance with said length of said image.

An amplitude of said peak section may remain substantially unchanged.

By extending said length of said peak section, a length of said gap may be adjusted in accordance with said length of said media to be printed with minimum computational effort. In particular, it is sufficient to determine a gap profile, and in particular a first section and a second section of said gap profile for a maximum media length, using conventional techniques. Based on this gap profile, gap profiles for smaller paper lengths may be derived simply by extending the length of said peak section, without modifying the shape of the first section or second sections or the amplitude of said peak section. This allows to adjust the gap profile dynamically and in response to the varying media lengths.

Said gap profile may be varied by shifting said second section of the gap profile relative to said first section of the gap profile in accordance with said length of said media to be printed and/or in accordance with said length of said image to be printed, or vice versa. Said first section or second section, respectively, of said gap profile may remain unchanged in position relative to said media to be printed or said image to be printed. This will result in a variation of the length of said peak section between said first section and said second section.

Said (second or first) section of the gap profile that may be shifted may correspond to a trailing edge of the gap profile, which is the section of the gap profile that faces the trailing edge of the media.

Said (first or second) section of said gap profile, whose position is not changed, may be a section of the gap profile facing a leading edge of said media to be printed.

In particular, said length of said peak section may be varied, in particular extended, by an amount that corresponds to a difference between a length of said media to be printed and a predefined media length.

Said predefined media length may be a maximum media length that can be accommodated by said printing system.

Said predefined media length may be defined by the angle or are covered by a mechanical recess in one of said first and second rollers, and it may take into account the diameter of said roller.

In an example, said gap profile is controlled to transition smoothly between said first portion of said gap profile and an adjacent second portion of said gap profile, said adjacent second portion corresponding to non-seam portions of said first roller and/or said second roller passing through said nip area.

In particular, said gap profile may be controlled to transition smoothly from said first portion into said second portion, and to transition smoothly from said second portion into said first portion.

A smooth transition, in the sense of the present disclosure, may be a transition that avoids perturbations in the boundary region between the printing zone and the seams and leads to a smooth response of the rollers at this boundary.

The smoothness is determined to a large extend by the shape of the first section of the gap profile and the shape of the second section of the gap profile and/or the amplitude or depth. Hence, by keeping the shape of the first section and the second section of the gap profile unchanged, and only varying a length of the peak section, a smooth transition can be achieved without having to compute or optimize a new gap profile for each change of media length or image length.

In an example, the method comprises the step of determining the length of said media to be printed or image to be printed. Said gap may then be adjusted in accordance with said determined media length or image length, respectively.

In an example, said length of said media may be determined by measuring a length of said media. Alternatively, the length of said media may be determined as a value input or selected by a user.

Said size of said gap may also be controlled in accordance with a thickness of said media.

The disclosure also relates to a printing system comprising a first roller and a second roller, wherein at least one of said first roller and said second roller comprises a seam, said seam corresponding to a variation of a diameter of said first roller and/or said second roller, respectively, along a circumference thereof. The printing system further comprises a nip area where said second roller is in rolling contact with said first roller under pressure, said nip area defining a gap for inserting a media to be printed. The printing system further comprises a control means adapted to control the size of said gap by varying a relative position of said first roller and said second roller when said at least one seam passes through said nip area, wherein said control means is adapted to adjust said gap in accordance with a length of said media to be printed and/or in accordance with a length of an image to be printed.

In an example, said control means is adapted to adjust a length of said gap in accordance with said length of said media to be printed.

Said first roller may be a transfer roller.

In particular, said first roller may comprise a cylinder and an elastic outer portion at least partially covering said cylinder. Said elastic outer portion may be a blanket.

Said second roller may be a media roller.

Said control means may be adapted to control said gap in accordance with a gap profile, said gap profile varying in a first portion corresponding to said seam passing through said nip area.

Said first portion may comprise a first section corresponding to an increase of said gap, a second section corresponding to a decrease of said gap, and a peak section formed between said first section and said second section, wherein said control means is adapted to adjust said gap by varying a length of said peak section in accordance with said length of said media and/or in accordance with said length of said image.

In particular, said control means may be adapted to extend said length of said peak section in accordance with said length of said media to be printed and/or in accordance with said length of said image to be printed.

Said printing system may further comprise a determination means coupled to said control means, said determination means adapted to determine said length of said media to be printed and/or said length of said image to be printed.

The disclosure further relates to a computer program product comprising computer-readable instructions adapted to control a printing system comprising a first roller and a second roller, wherein at least one of said first roller and said second roller comprises a seam, said seam corresponding to a variation of a diameter of said first roller and/or said second roller, respectively, along a circumference thereof. Said printing system further comprises a nip area where said second roller is in rolling contact with said first roller under pressure, said nip area defining a gap for inserting the media to be printed. Said computer-readable instructions are adapted to cause control means to control the size of said gap by varying a relative position of said first roller and said second roller when said at least one seam passes through said nip area, and to adjust said gap in accordance with the length of said media to be printed and/or in accordance with a length of an image to be printed.

One example of a sheet-fed printing system 10 is illustrated in FIG. 1. The printing system 10 in FIG. 1 is a liquid electro photographic printing (LEP) machine that comprises a laser imager 12, an imaging roller 14, a transfer roller 16, and a media roller 18.

The imaging roller 14 is in rolling contact with the transfer roller 16 at a first interaction zone or rolling transfer zone T1 corresponding to a first nip area, and the transfer roller 16 is in turn in rolling contact with the media roller 18 at a second interaction zone or transfer zone T2 corresponding to a second nip area. In addition, the printing system 10 comprises a charging station 20, a developing station 22, and a control means or controller 24.

The printing system further comprises a control means 24 that is coupled to a positioning means 54 and a media length determination means 62.

The imaging roller 14 comprises a cylinder 26 rotating about a central axis a. An outer electrophotographic surface or plate 28, such as a photoconductor, is formed on the cylinder 26.

As can be further taken from FIG. 1, the transfer roller 16 likewise comprises a cylinder 30 adapted to rotate about an axis b that extends in parallel to axis a of the imaging roller 14. A blanket 30 may be formed to extend circumferentially around the cylinder 30 of the transfer roller 16.

While not shown in FIG. 1, the printing system 10 may additionally comprise excess ink collection mechanisms, cleaners, additional rollers and the like, as in will be familiar to those skilled in the art. A brief description of the operation of the printing system 10 follows.

In preparation to receive an image, the imaging roller 14 receives a charge from the charging station 20, which may be a charge roller or a scorotron, in order to produce a uniformly charged surface of the imaging roller 14. As the imaging roller 14 rotates about the axis a, as represented by directional arrow A in FIG. 1, the laser imager 12 projects an image beam 34 onto the outer electrographic surface 28 of the imaging roller 14, thereby discharging portions of the imaging roller 14 corresponding to the image. These discharged portions are developed with ink via developing station 22 to "ink" the image. As the imaging roller 14 continues to rotate along direction A, the image is transferred onto the electrically biased blanket 32 of the transfer roller 16 at the first interaction zone T1.

The blanket 32 of the transfer roller 16 is usually kept at an elevated temperature, typically around 100 and serves to fuse the ink and to dry the ink while it is being transferred to the second interaction zone T2 as the transfer roller 16 continues to rotate about the central axis b, as represented by directional arrow B. The blanket 32 of the transfer roller 16 may be a rubber blanket with several different layers. The top layer may be a layer of silicone rubber, with a thickness of typically in the range of 5 μm. This top layer serves for releasing the ink onto a media M, such as a sheet of paper that passes through a pressure nip or gap 36 between the transfer roller 16 and the media roller 18.

The media roller 18 comprises a cylinder 38 adapted to rotate about the axis c in a direction C that is opposite the rotation direction B of the transfer roller 16. The media roller 18 may serve to supply the media M to the interaction zone T2, with the media M being wrapped around and attached to an outer portion 40 of the cylinder 38.

In this example, the distance of the separation between the media M and the cylinder 30 of the transfer roller 16 in the interaction zone T2 is referred to as a gap between the rollers of the printing system 12. Nevertheless, it is understood that the gap does not represent an actual void, because the media roller 18 and the media M, respectively, are in rolling contact with the blanket 32 of the transfer roller 16. When no media is fed into the printing system 10, the gap may be understood to denote the distance of the separation between the media roller 18 and the cylinder 30 of the transfer roller 16. This corresponds to zero media thickness. Hence, the gap can be characterized independently of the media thickness, and does not include the media thickness.

Figure 2A:
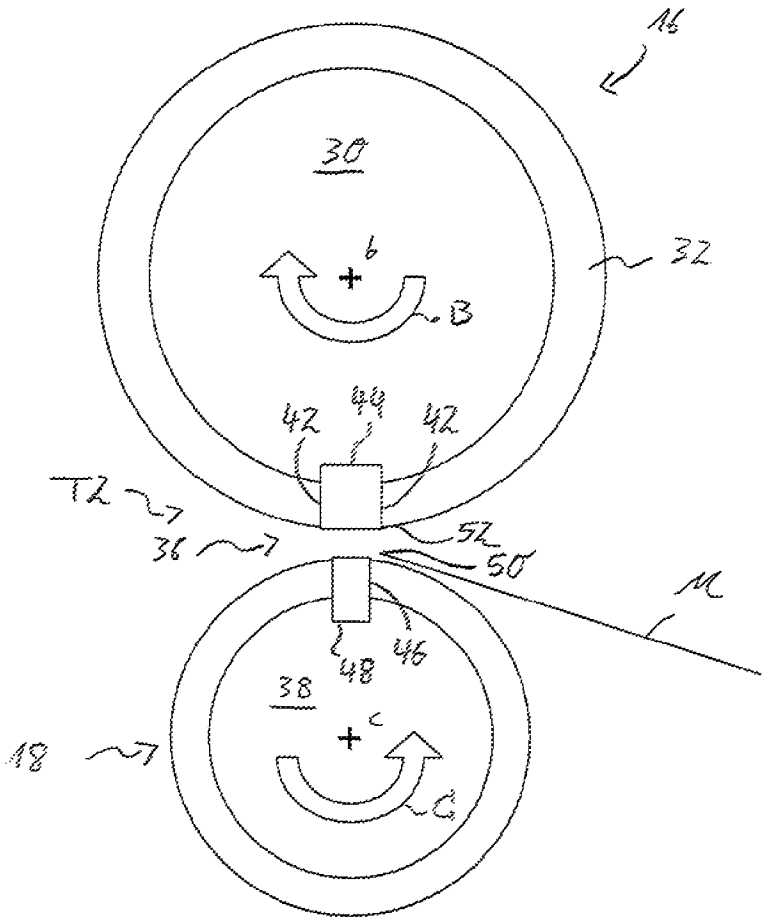
FIG. 2*a* is a schematic close-up of a nip area between a transfer roller and a media roller each comprising discontinuities or seams according to an example.

A more detailed view of the interaction zone T2 between the transfer roller 16 and the media roller 18 is shown in FIG. 2*a*. As can be taken from FIG. 2*a*, the blanket 32 formed on the cylinder 30 is a sheet with opposing edges at which the blanket is attached to the cylinder 30 by means of clamping means or attachment means 42. The clamping means 42 are formed at opposing edges of the blanket 32 and clamp into a recess 44 formed in the surface of the transfer roller 16.

Figure 2B:
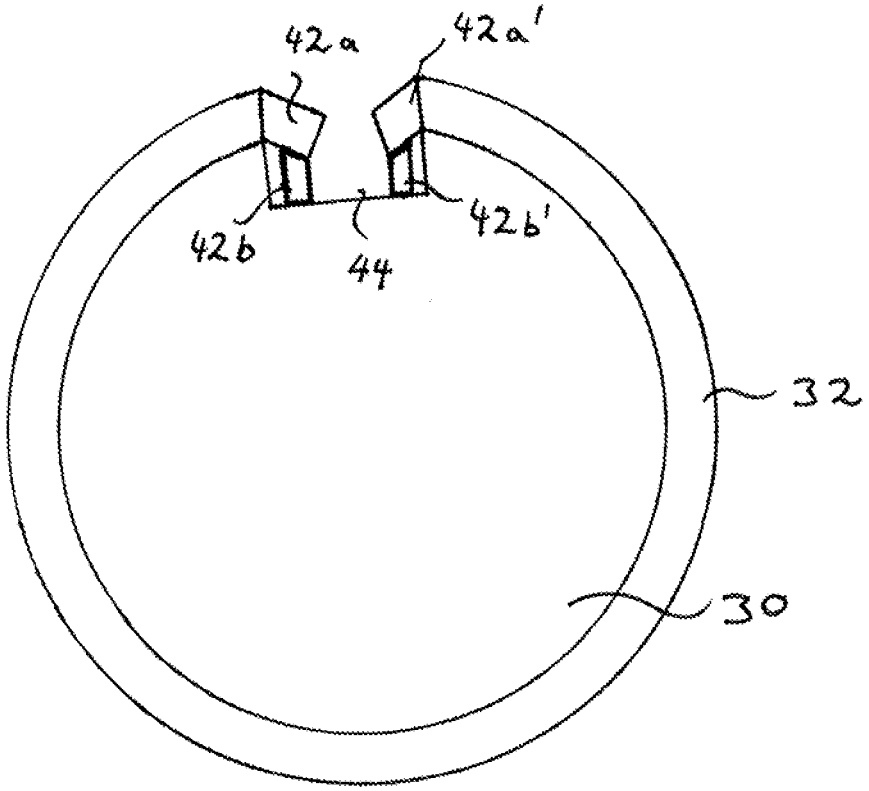
FIG. 2*b* shows an example of a clamping mechanism for attaching a blanket to the transfer roller.

An example of a clamping mechanism with two clamps 42*a*, 42*a* at opposing edges of the blanket 32 for connection to respective clamp holders 42*b*, 42*b*' that are mounted in the recess 44 is shown schematically in FIG. 2*b*.

The damping mechanism allows the blanket 32 to be replaced upon failure or at continuous maintenance intervals. The recess 44 results in a local decrease of the diameter of the transfer roller 16 compared to the adjacent non-seam areas.

As further shown in FIG. 2*a*, the media roller 18 is likewise provided with attachment means or clamping means 46 for attaching or clamping a leading edge 50 of the printing media inserted into the gap 36. The attachment means 46 are provided in a recess 48 of the media roller 18, and hence likewise results in a variation of the diameter of the media roller 18 along a circumference thereof.

In this example, the media edge that is attached to the clamping means 46 will be referred to as the media leading edge 50 and is always held in the same fixed position by means of the clamping means 46. The opposite edge of the media will be referred to as the trailing edge, and its position along the media roller 18 may vary in accordance with the media length.

In this example, variations of the diameter of the transfer roller 16 and media roller 18 are generally referred to as a seam.

As can be taken from FIG. 2*a*, the media M is fed into the gap 36 and attached to the clamping means 46 so that it can wrap around the outer portion 40 of the cylinder 38 of the media roller 18 and can be imprinted through contact with the blanket 32. The rotation of the transfer roller 16 and the rotation of the media roller 18 are generally synchronized such that the leading edge 50 of the media M and the leading edge 52 of the blanket 32 match in the interaction zone T2.

However, the diameter of the transfer roller 16 may be different from the diameter of the media roller 18, and hence the seams of the rollers may not match in every rotation. For instance, if the diameter of the transfer roller 16 is twice the size of the diameter of the media roller 18, the seams will only match every other rotation.

The seams of the transfer roller 16 and the media roller 18 lead to a variation in the size of the gap 36 in the interaction zone T2, which may disrupt a sensitive pressure distribution and may affect the quality of the printing on the media M. In order to compensate for these seams, the printing system 10 is provided with a positioning means 54 that is controlled by said controller 24 and is adapted to vary a relative distance between the transfer roller 16 and the media roller 18 to compensate for variations in the diameters of the transfer roller 16 and media roller 18, respectively, as will now be explained in greater detail with reference to FIG. 3.

Figure 3:
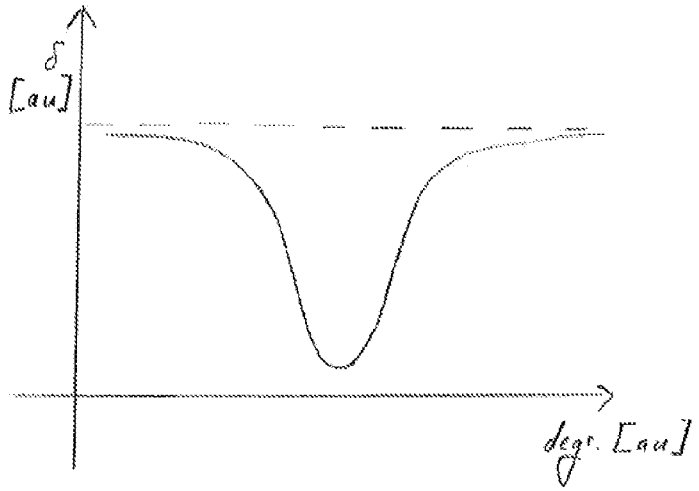
FIG. 3 illustrates a gap profile for controlling the size of a gap when a seam passes through the nip area in a printing system.

FIG. 3 shows a feed forward profile or gap profile that illustrates a vertical displacement δ from a constant state of the relative distance between the transfer roller 16 and the media roller 18 at the seam area as a function of a process direction angle degr. (in arbitrary units). The process direction angle may correspond to a rotation angle of the transfer roller 16, or the media roller 18. In the seam area, the feed forward profile has a dip, corresponding to a change, in particular an increase in distance between the central axes b and c of the transfer roller 16 and media roller 18 at the seam area. This dip is chosen such as to accurately compensate for the recess 44 of the transfer roller 16 and/or the recess 48 of the media roller 18 in the seam area. This avoids pressure overshoots when reentering the non-seam rolling contact area after passing the seam. Effectively, the gap profile can be selected so that the depth of the gap 36 between the rollers 16, 18 remains essentially constant when transitioning through the seam, even though the force between the rollers 16, 18 may be dramatically reduced.

In the printing zones away from the seam areas, a different independent control may be employed to adjust a relative position between said transfer roller 16 and said media roller 18. This independent control may be a feedback mechanism that either controls the pressure between the rollers 16, 18 or the size of the gap 36 between them. The feedback control may keep the pressure or the gap between the rollers 16, 18 constant even under various perturbations.

Irrespectively of the type of the control in the printing zone, the transition to the gap control in the seam area should be continuous and smooth, both at where the pressure or gap control goes over into the seam gap control and where the seam gap control transitions back into the pressure or gap control.

A gap profile that ensures a smooth transition can be determined by measuring the variation of the gap 36 as a result of the seam/seams, as described in greater detail in United States patent application US 2011/0150517 A1.

Figure 4:
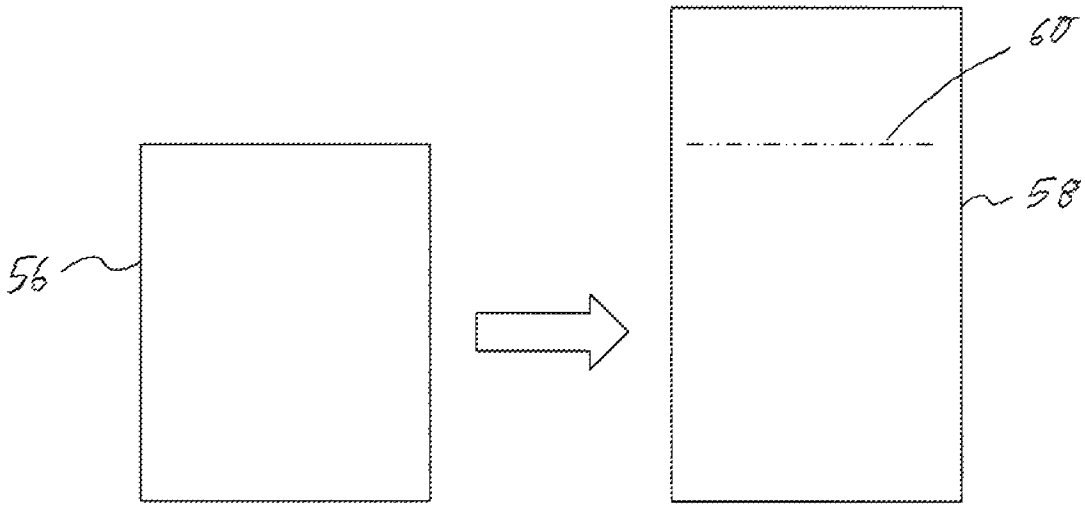
FIG. 4 illustrates paper size marks that may occur when printing on long pages after printing on short pages in a printing system.

The use of the gap profile allows to greatly enhance the quality of the printing. However, problems remain if long media 58 are printed after shorter media 56. The top layer of the blanket 32 is typically highly sensitive to mechanical abrasion, and the high mechanical pressure in the nip area T2 may hence engrave the media edges of the media 56 onto the blanket 32. These blanket engravings when caused by short media are later shown on the long media 58 as undesirable paper size marks 60, as illustrated schematically in FIG. 4.

The effect of the paper size marks can be greatly alleviated by varying the gap profile in accordance with the varying length of said media to be printed. To this end, the printing system 10 is equipped with a media length determination means 62 that determines the length of the media M fed into the gap 36. There are several ways of how the media length 62 may be determined in examples of the present disclosure. In one example, the user inputs the corresponding media length. In another example, the media length is measured in the printing system 10 as the media M is fed towards said gap 36.

The media length determination means 62 is electrically connected to the controller 24, which allows the controller 24 to read out the media length and to adjust the gap profile in accordance with the media length to compensate for shorter media. In particular, the length of said gap (given in terms of the process angle or in terms of a time length or duration) may be extended as the length of the media to be printed is decreased.

Figure 5:
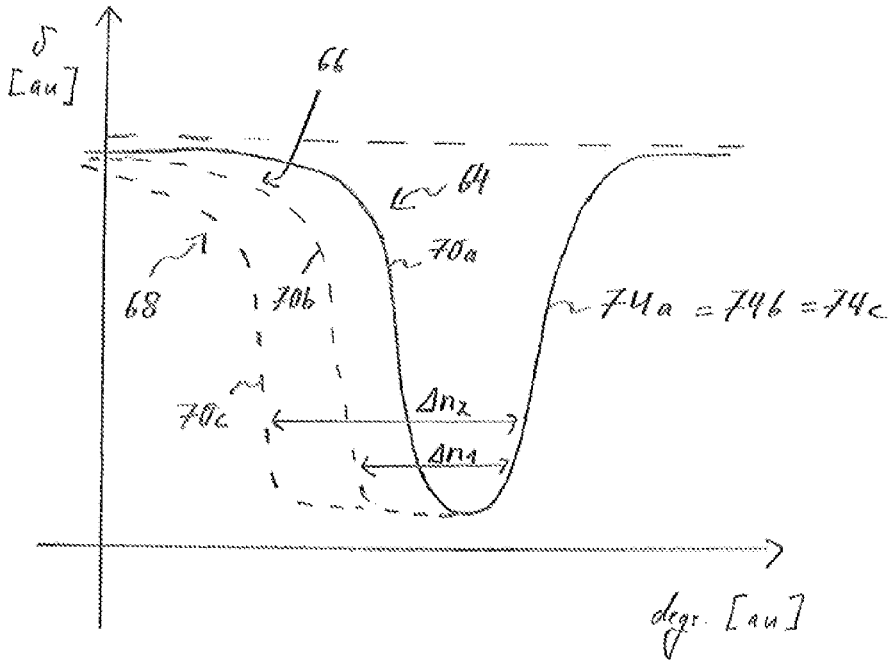
FIG. 5 illustrates an adjustment of the gap profile in accordance with the media length in an example.

Examples of three different gap profiles that correspond to three different media lengths are shown in FIG. 5. These gap profiles again show a vertical displacement 6 (in arbitrary units) of the gap depth from a steady state as a function of a process direction angle (in arbitrary units). In FIG. 5, the reference for the steady state is chosen such that the dip in the gap profile corresponds to an increase of the distance between the central axis b, c of the transfer roller 16 and media roller 18. However, this is purely conventional, and in other representations the dip in the gap profile corresponds to a decrease of the distance between the central axis b, c of the transfer roller 16 and media roller 18. Hence, what is subsequently referred to as a decreasing section of the gap profile can in other embodiments be an increasing section, and vice versa.

Profile 64 is a gap profile for a long media, and corresponds to the gap profile shown in FIG. 3. Profile 66 is a gap profile for a medium-length media, whereas profile 68 is a gap profile for a short media.

As can be taken from FIG. 5, the gap profiles 64, 66 and 68, each comprise a decreasing section 70*a*, 70*b*, 70*c*, corresponding to an increasing distance between the central axes b, c of the transfer roller 16 and media roller 18. The decreasing sections 70*a*, 70*b*, 70*c* are each followed in the profile gap by respective peak sections 72*a*, 72*b*, 72*c*, at which the relative distance between the central axes b and c of the transfer roller 16 and media roller 18, respectively, is kept approximately constant. The peak sections 72*a*, 72*b*, 72*c* are in turn followed by respective increasing sections 74*a*, 74*b*, 74*c* of the gap profile 64, 66, 68, respectively. At the increasing sections 74*a*, 74*b*, 74*c*, the distance between the central axes b, c of the transfer roller 16 and media roller 18, respectively, is reduced back to the steady state that corresponds to the non-seam portions. Thereafter, the gap profile may continuously and smoothly transition into the adjacent non-seam portions, as will be described in greater detail below.

In the gap profile of the example of FIG. 5, the increasing sections 74*a*, 74*b*, 74*c*, each correspond to the leading edge of the respective media, and are of identical shape. However, the peak sections 72*a*, 72*b*, 72*c* are shifted with respect to one another in accordance with the varying media length. In the example of FIG. 5, the peak section 72*b* of the gap profile for the medium-sized media is extended by an amount $\Delta n_1$ with respect to the length of the peak section 72*a* of the long media. The peak section 72*c* of the short media is extended by an amount $\Delta n_2 > \Delta n_1$ with respect to the peak section 72*a* of the long media. The decreasing sections 70*a*, 70*b*, 70*c*, are identical in shape, but are shifted with respect to one another as a consequence of the extended peak sections.

The shifts $\Delta n_1$ and $\Delta n_2$ may be chosen such that the distance between the decreasing sections 70*a*, 70*b*, 70*c* of the gap profiles 64, 66, 68 and the respective trailing edge of the media remains constant, or approximately so, for all different media lengths. This may allow to significantly reduce the appearance of paper size marks and decrease the paper size mark amplitude.

The varying media length is determined by means of the media length determination means 62 as the media is fed towards the interaction zone T2. The controller 24 reads the media length from the media length determination means 62, and adapts the gap profile as described above with reference to FIG. 5 to accommodate for changes in the paper length. In accordance with the adapted gap profile, the controller 24 then instructs the positioning means 54 to adjust the gap 36 in accordance with the media length.

In the example shown in FIG. 5, the length of the gap profile is adjusted merely by adjusting the length of the peak section, whereas the amplitude of the vertical displacement is not changed and the curve shapes of the decreasing sections and the increasing sections of the gap profile likewise remain the same. This supersedes the need to determine gap profiles separately for each respective media length. The gap profile may rather be amended simply by stretching the peak section, which requires little computational resources and can be executed in real time as media of different length are printed.

For instance, a first gap profiles such as the gap profile shown in FIG. 3 may be determined so to ensure a continuous and smooth transition between the seam areas and the adjacent printing zone. This gap profile may correspond to a fixed media length, such as a maximum media length. It may be stored in a look-up table in the controller 24.

This first gap profile may then be divided at the peak or external point into a decreasing section and an increasing section. In order to derive gap profiles for smaller media length, the points in the look-up table corresponding to the peak section are simply displaced in accordance with the media length. There is no need to add additional points to the look-up table. Only the angle or are coordinate of the look-up table containing the profile is changed.

In particular, since neither the decreasing section of the gap profile nor the increasing section of the gap profile is changed in shape, the extended profile will again ensure continuity at the boundary region with the non-seam areas.

However, in alternative examples different gap profiles comprising different shapes of the increasing portion, peak portion and decreasing portion may be determined for different paper lengths, and may be selected by the controller 24. This may be appropriate in configurations in which the user is allowed to select only between a limited number of fixed, predetermined media lengths.

In general, the decreasing section of the gap profile and the increasing section of the gap profile may extend beyond the seam area and into the printing zone. This may be desirable to ensure a smooth transition of the gap profile in the seam area and in the non-seam area. However, the overlap of the profiles may lead to degradations of the printing quality close to the paper edge, resulting in a trade-off between the desire to avoid paper size marks and the need to maintain a high printing quality even in the vicinity of the media edge. The further away the image is from the media edge, the higher is the overlap that may be tolerated without sacrificing printing quality. This may allow to extend the gap profile further into the non-seam area or printing zone for shorter images, or, in other words, images that are further away from the trailing edge of the media.

The length of the gap may hence be adjusted in accordance with the length of an image to be printed, either alternatively or additionally to the adjustment based on the length of the media described above. In particular, the length of the gap may be increased if the length of the image is decreased, and vice-versa. In this context, the length of the image can be understood to denote a length measured from the leading edge of the media. Hence, the higher the length of the image, the shorter the distance between the bottom of the image and the trailing edge. The length of the image may exclude print control signs such as crop marks, finishing marks, barcodes, color control patches, etc. that may appear in the vicinity of the trailing edge of a media.

The adjustment of the gap in accordance with the length of the media to be printed and/or in accordance with the length of an image to be printed can be different for different color separations.

The description of the examples and the figures merely serve to illustrate the invention, but should not be understood to imply any limitation. The scope of the invention is to be determined solely by means of the appended claims.

REFERENCE SIGNS

10 printing system
12 laser imager
14 imaging roller
16 transfer roller
18 media roller
20 charging station
22 developing station
24 controller
26 cylinder of imaging roller 14
28 outer electrographic surface of imaging roller 14
30 cylinder of transfer roller 16
32 blanket
34 image beam
36 gap, pressure nip
38 cylinder of media roller 18
40 outer portion of cylinder 28
42 attachment means for blanket 32
42*a*, 42*a*' clamps of blanket 32
42*b*, 42*b* clamp holders of cylinder 30
44 recess of the transfer roller 16
46 attachment means for media
48 recess of the media roller 18
50 leading edge of media M
52 leading edge of blanket 32
54 positioning means
56 short media
58 long media
60 paper size marks
62 media length determination means
64 gap profile for long media
66 gap profile for medium-size media
68 gap profile for short media
70*a,b,c* decreasing section of gap profiles 64, 66, and 68, respectively
72*a,b,c* peak section of gap profiles 64, 66, and 68, respectively
74*a,b,c* increasing section of gap profiles 64, 66, and 68, respectively

What is claimed is:

1. A method for adjusting a gap in a printing system, comprising:

providing a first roller and a second roller, wherein at least one of said first roller and said second roller comprises a seam, said seam corresponding to a variation of a diameter of said first roller and/or said second roller, respectively, along a circumference thereof;

providing a nip area where said second roller is in rolling contact with said first roller under pressure, said nip area defining a gap for inserting a media to be printed;

controlling a size of said gap by varying a relative position of said first roller and said second roller when said at least one seam passes through said nip area; and adjusting said gap in accordance with a length of said media to be printed and/or in accordance with a length of an image to be printed.

2. The method according to claim 1, wherein a length of said gap is adjusted in accordance with said length of said media to be printed and/or in accordance with said length of said image to be printed.

3. The method according to claim 1, wherein a length of said gap is increased if said length of said media is decreased and/or said length of aid image is decreased.

4. The method according to claim 1, wherein a length of said gap is decreased if said length of said media is increased and/or said length of said image is increased.

5. The method according to claim wherein depth of said gap remains substantially constant.

6. The method according to claim 1, wherein said seam corresponds to a recess in said first roller and/or said second roller.

7. The method according to claim 1, wherein said gap is controlled in accordance with a gap profile, said gap profile varying in a first portion corresponding to said seam passing through said nip area.

8. The method according to claim 7, wherein said gap is adjusted so that a distance between said first portion and a trailing edge and/or a leading edge of said media remains substantially constant.

9. The method according to claim 7, wherein said step of adjusting said gap comprises a step of stretching said first portion of said gap profile.

10. The method according to claim 7, wherein said first portion comprises a first section corresponding to an increase of said gap, a second section corresponding to a decrease of said gap, and a peak section formed between said first section and said second section, wherein adjusting said gap comprises varying a length of said peak section in accordance with said length of said media and/or in accordance with said length of said image, in particular extending a length of said peak section in accordance with said length of said media and/or in accordance with said length of said image.

11. The method according to claim 10, wherein said length of said peak section is varied by an amount that corresponds to a difference between a length of said media or image to be printed and a predefined media length.

12. The method according to claim 7, wherein said gap profile is controlled to transition smoothly between said first portion of said gap profile and an adjacent second portion of said gap profile, said adjacent second portion corresponding to non-seam portions of said first roller and/or said second roller passing through said nip area.

13. A printing system, comprising:

a first roller and a second roller, wherein at least one of said first roller and said second roller comprises a seam, said seam corresponding to a variation of a diameter of said first roller and/or said second roller, respectively, along a circumference thereof;

a nip area where said second roller is in rolling contact with said first roller under pressure, said nip area defining a gap for inserting a media to be printed; and a control means adapted to control a size of said gap by varying a relative position of said first roller and said second roller when said at least one seam passes through said nip area;

wherein said control means is adapted to adjust said gap in accordance with a length of said media to be printed and/or in accordance with a length of an image to be printed.

14. The printing system according to claim 13, wherein said control means is adapted to adjust a length of said gap in accordance with said length of said media to be printed and/or in accordance with said length of said image to be printed.

15. The printing system according to claim 13, wherein said first roller is a transfer roller.

16. The printing system according to claim 13, wherein said first roller comprises a cylinder and an elastic outer portion at least partially covering said cylinder, in particular a blanket.

17. The printing system according to claim 13, wherein said second roller is a media roller.

18. The printing system according to claim 13, wherein said control means is adapted to control said gap in accordance with a gap profile, said gap profile varying in a first portion corresponding to said seam passing through said nip area.

19. The printing system according to claim 18, wherein said first portion comprises a first section corresponding to an increase of said gap, a second section corresponding to a decrease of said gap, and a peak section formed between said first section and said second section, wherein said control means is adapted to adjust said gap by varying a length of said peak section in accordance with said length of said media and/or in accordance with said length of said image, in particular extending a length of said peak section in accordance with said length of said media and/or in accordance with said length of said image.

20. A computer program product comprising computer-readable instructions adapted to control a printing system comprising a first roller and a second roller, wherein at least one of said first roller and said second roller comprises a seam, said seam corresponding to a variation of a diameter of said first roller and/or said second roller, respectively along a circumference thereof, said printing system further comprising a nip area where said second roller is in rolling contact with said first roller under pressure, said nip area defining a gap for inserting a media to be printed:

wherein said computer-readable instructions are adapted to cause a control means to control a size of said gap by varying a relative position of said first roller and said second roller when said at least one seam passes through said nip area, and to adjust said gap in accordance with a length of said media to be printed and/or in accordance with a length of an image to be printed.

* * * * *

UNITED STATES PATENT AND TRADEMARK OFFICE

CERTIFICATE OF CORRECTION

PATENT NO. : 9,182,706 B1
APPLICATION NO. : 14/265157
DATED : November 10, 2015
INVENTOR(S) : Uri Lidai et al.

It is certified that error appears in the above-identified patent and that said Letters Patent is hereby corrected as shown below:

Claims

In column 12, line 48, in Claim 3, delete “aid” and insert -- said --, therefor.

In column 12, line 52, in Claim 5, delete “claim” and insert -- claim 3, --, therefor.

In column 12, line 52, in Claim 5, delete “wherein” and insert -- wherein a --, therefor.

In column 14, line 34 approx., in Claim 20, delete “printed:” and insert -- printed; --, therefor.

Signed and Sealed this
Seventh Day of June, 2016

Michelle K. Lee

Michelle K. Lee
*Director of the United States Patent and Trademark Office*